US009181746B2

(12) United States Patent
Nguyen et al.

(10) Patent No.: US 9,181,746 B2
(45) Date of Patent: Nov. 10, 2015

(54) LOW PROFILE HIGH PERFORMANCE CASEMENT AND AWNING WINDOW KEEPER

(71) Applicant: Truth Hardware Corporation, Owatonna, MN (US)

(72) Inventors: Nghi Christopher Nguyen, Owatonna, MN (US); Michael Neff, Owatonna, MN (US); Lee Bauman, Owatonna, MN (US); Loren Rysavy, Owatonna, MN (US); Derek Ronald Gramstad, Owatonna, MN (US); Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 14/157,882

(22) Filed: Jan. 17, 2014

(65) Prior Publication Data

US 2014/0196376 A1 Jul. 17, 2014

Related U.S. Application Data

(60) Provisional application No. 61/753,804, filed on Jan. 17, 2013.

(51) Int. Cl.
*E06B 3/44* (2006.01)
*E05C 9/18* (2006.01)
(Continued)

(52) U.S. Cl.
CPC ..... *E06B 3/44* (2013.01); *E05C 9/1808* (2013.01); *E05B 63/04* (2013.01); *E05B 2015/1671* (2013.01); *E05C 9/1858* (2013.01); *Y10T 292/696* (2015.04)

(58) Field of Classification Search
CPC ..... E06B 3/44; E05C 9/1808; E05C 9/1858; E05B 63/04; E05B 2015/1671; Y10T 292/696
USPC ..... 49/381, 394; 292/32, 30, 137, 143, 292/DIG. 20, DIG. 47
See application file for complete search history.

(56) References Cited

U.S. PATENT DOCUMENTS 1,385,102 A 7/1921 Winters et al.
2,548,578 A 4/1951 Fogde et al.
(Continued)

OTHER PUBLICATIONS

Truth Brochure for "Non-Handed, Low Profile Sash Lock" (1988) pp. 15-15a.
(Continued)

*Primary Examiner* — Katherine Mitchell
*Assistant Examiner* — Catherine A Kelly
(74) *Attorney, Agent, or Firm* — Patterson Thuente Pedersen, P.A.

(57) ABSTRACT

A locking mechanism for use with a window having a hinge coupling a sash to a frame includes a keeper and a locking lug. The keeper includes a generally planar base plate that is abutable to a surface of either the sash or the frame and two wings extending upwardly from the base, each of the wings having an upwardly and inwardly extending portion extending from the base plate and an inwardly extending portion extending inwardly substantially parallel to the base plate from the upwardly and inwardly extending portion. The two inwardly extending portions define a gap therebetween. The planar base further includes at least one self locating leg extending outward and coplanar with the base. The self locating leg adapted to abut a portion of the sash or the frame. Thus, the keeper is positionable without a fixture.

14 Claims, 5 Drawing Sheets

(51) Int. Cl.
*E05B 63/04* (2006.01)
*E05B 15/16* (2006.01)

(56) References Cited

U.S. PATENT DOCUMENTS

| | | | | | |
|---|---|---|---|---|---|
| 3,032,330 | A | | 5/1962 | Stavenau | |
| 3,949,525 | A | | 4/1976 | Bates et al. | |
| 4,148,106 | A | | 4/1979 | Gallien | |
| 4,602,457 | A | | 7/1986 | Kreusel | |
| 4,739,583 | A | | 4/1988 | Tonsmann et al. | |
| 4,803,808 | A | | 2/1989 | Greisner | |
| 4,980,946 | A | | 1/1991 | Verasani et al. | |
| 4,991,886 | A | | 2/1991 | Nolte et al. | |
| 5,045,265 | A | | 9/1991 | Petit | |
| 5,087,087 | A | | 2/1992 | Tucker et al. | |
| 5,118,145 | A | | 6/1992 | Tucker | |
| 5,120,094 | A | * | 6/1992 | Eaton et al. | 292/159 |
| 5,152,103 | A | * | 10/1992 | Tucker et al. | 49/279 |
| 5,370,428 | A | | 12/1994 | Dreifert et al. | |
| 5,603,538 | A | | 2/1997 | Evers | |
| 5,642,909 | A | | 7/1997 | Swan et al. | |
| 5,741,031 | A | | 4/1998 | Bauman et al. | |
| 5,778,602 | A | | 7/1998 | Frenzen | |
| 5,839,767 | A | | 11/1998 | Piltingsrud | |
| 5,927,767 | A | | 7/1999 | Kuersten et al. | |
| 5,927,768 | A | | 7/1999 | Dallmann et al. | |
| 6,135,511 | A | * | 10/2000 | Smith et al. | 292/156 |
| 6,161,881 | A | | 12/2000 | Babka et al. | |
| 6,367,853 | B1 | | 4/2002 | Briggs | |
| 6,442,899 | B1 | | 9/2002 | Gledhill | |
| 6,477,810 | B2 | | 11/2002 | Van De Keuken | |
| 6,651,389 | B2 | | 11/2003 | Minter | |
| 6,837,004 | B2 | * | 1/2005 | Annes | 49/394 |
| 7,004,515 | B2 | | 2/2006 | Timothy | |
| 7,452,014 | B2 | | 11/2008 | Vetter | |
| 7,708,322 | B2 | * | 5/2010 | Timothy et al. | 292/137 |
| 7,946,633 | B2 | * | 5/2011 | Minter | 292/23 |
| 2010/0270814 | A1 | * | 10/2010 | Labarre | 292/144 |

OTHER PUBLICATIONS

Truth Brochure for "Non-Handed, Low Profile Sash Lock" (1991) pp. 12-12c.

* cited by examiner

LOW PROFILE HIGH PERFORMANCE CASEMENT AND AWNING WINDOW KEEPER

RELATED APPLICATION

The present application claims the benefit of U.S. Provisional Application No. 61/753,804, filed Jan. 17, 2013, which is incorporated herein in its entirety by reference.

FIELD OF THE INVENTION

The present invention relates to casement and awning windows and, more specifically, to locking devices for securing casement and awning windows closed.

BACKGROUND OF THE INVENTION

A casement or an awning window generally refers to a sash that is attached to its frame by one or more hinges. The hinges can be located on any side of the sash and the frame though generally not on the lower edge of the sash and frame. In general, a casement window rotates along a horizontal plane (the hinges of a casement window defining a vertical rotation axis), while an awning window rotates along a vertical plane (the hinges of an awning window defining a horizontal rotation axis). Most casement and awning windows which employ the use of a crank lever or cam handle operator open outwardly so as not to interfere with the operator of the window.

An advantage of many casement and awning windows is that substantially the full window opening can be exposed without requiring the removal of the window from the frame. In contrast, for example only half of the opening of a double-hung window can be exposed by raising the lower sash or lowering the upper sash. The sashes of double hung or horizontally sliding windows must be completely removed from the frame to expose the entire window opening.

Manufacturers of windows continue to provide higher performance windows having higher design performance. At the same time, manufacturers of windows seek ways to simplify the manufacturing process to reduce complexity.

Keepers are secured to either to the sash or the window frame and are engaged by a locking mechanism to secure the window in a closed position. Keepers must capture and hold a lock point in extreme performance conditions. These extreme performance conditions include high wind loading, as well as conditions that may occur to the window during shipping, handling and installation. Under these circumstances, high stresses may be placed on the window sash within the frame, which tend to force the window toward an open position.

Casement and awning windows are manufactured in a wide variety of profiles and materials. Casement and awning windows may be manufactured with wood, vinyl, aluminum or composite sashes and frames. This variability of window design and component materials presents challenges to keeper application and performance.

In general, current keeper designs provide good window performance in real application situations as well as test environments so long as the windows are structurally sound. Variability in window profiles, especially when window structures are formed of vinyl, can provide considerable challenges to design and strength requirements for a locking mechanism.

Some keepers may provide desired performance but require complicated jigs for proper positioning. Other prior art keepers may function appropriately and have desired features, but the structure of the keeper in combination with the strength profile of the material from which the window members are made sometimes permits window members to rotate or twist thus disengaging the locking mechanism from the keeper. This disengagement can cause the window to fail under high stress conditions. In some circumstances, a keeper may provide sufficient function and performance but be aesthetically unacceptable or may require complicated installation or may require a particular placement of the hardware that is undesirable to window manufacturers.

There exist in the prior art some non-handed low profile keepers which include a self-locating feature. A non-handed keeper is a keeper that can be used either in a right handed or left handed window without the need for two separate keepers for right handed and left handed windows.

Unfortunately, some of these keeper designs, when applied to a less rigid frame member, can be subject to separation. When the window is closed and locked, the keeper engages a lock lug. In some window structures having lesser rigidity, when subject to stress, the window sash can deflect causing a sash or frame member to rotate, which in turn causes the locking lug to disengage from the keeper, thus releasing the window sash from the frame in the lock position.

The prior art includes some non-handed keepers formed in a C-shape. These keepers lack a self-locating feature and have screw hole locations in the center of the keeper which may make for awkward installation.

Some prior art keepers also have a steep ramp angle where the locking lug enters the keeper. The steep ramp angle can make operation of the keeper difficult in that it is hard to engage the locking lug within the keeper. Further, these prior art keepers generally require a fixture or jig in the factory to be properly located on the window sash or window frame.

Other known prior art keepers are either handed in that they must be produced in left or right handed versions depending upon their application or lack in self-locating features thus requiring a jig or fixture for installation. Accordingly, there is still room for improvement in the area of window hardware involved in casement and awning window keepers and locking lug engagement devices.

SUMMARY OF THE INVENTION

The invention substantially addresses the aforementioned needs of the industry.

Throughout this application structures may be referred to as being associated with a window sash or frame for convenience of description. It is to be understood that the embodiments of the invention described herein can generally be reversed so that the sash component can be attached to the frame and/or the frame component can be secured to the sash. Accordingly, the fact that this specification refers to a sash component or a frame component should not be considered limiting to the inventions disclosed herein.

The keeper of the present invention is formed as a channel having a C-shaped channel cross section. The cross section leaves an open slot or gap of a required dimension to engage a locking lug. This slot or gap is formed between two wings of the keeper that include entrance ramps at each end having a gradual constantly changing ramp angle to allow for smooth locking and easy engagement of the locking lug in the gap. The design of the inventive keeper is such that if the window is put under extreme stress conditions either in testing or in environmental conditions and the sash or frame begins to deflect causing the locking lug or rivet to tip, the head of the locking lug is captured and held in place by the opposing wings of the slot. The opposing wings engage both sides of the head of the locking lug rivet providing additional strength in the keeper to inhibit failure of the window system under stress conditions.

Embodiments of the invention are advantageous in that during high wind load conditions that cause large bending deformation in the sash, a double sided keeper traps the head of the lug and inhibits the tendency of the lug to disengage from the keeper due to rolling rotation of the sash rail. Also, in a negative air loading condition, the head and body of the lug are trapped inside the keeper, limiting some of the tipping motion of the lug and creating more of a shear load versus bending load on the lug, enabling a higher strength rating of the lock system.

The keeper also includes at least one self-locating tab or leg which provides for ease of placement in the manufacturing process. The self-locating tab or tabs are design such that the tab profile has a specific length to allow the keeper to be placed in the correct location relative to an abutting structure every time applied. The self-location tab or tabs reduce placement mistakes in the manufacturing process and may allow faster assembly in the manufacturing process. The self-locating tab or tabs may be adjusted to have a specific desired length for each application by use of an adjustable tool in the keeper manufacturing or installation process. The adjustable tool may be used to cut or adjust a long self locating tab to a shorter length.

The keeper of the present invention is non-handed and can be used for left or right handed applications. This reduces complexity and simplifies the manufacturing process.

The keeper of the present invention has a low profile structure for a pleasing aesthetic appearance when applied to the window sash or frame. The structure of the keeper provides a clean and less intrusive appearance to the hardware on the sash or frame when the keeper is applied.

The keeper of the present invention is a generally unitary structure and generally is stamped and formed of metal but may also be manufactured by casting or other approaches such as extrusion or injection molding with polymers.

The keeper of the present invention may also be formed of other material having sufficient strength and rigidity to meet the stress applied to the keeper.

A locking mechanism, according to the invention, generally includes a keeper and a locking lug. The locking lug is operably coupled to other movable locking structures. The keeper engages the locking lug to secure the sash to the window frame.

The keeper generally includes a base plate, and upwardly extending wings. The base plate of a keeper according to the present invention includes a central portion, a first peripheral portion and a second peripheral portion. The base plate is generally a planar structure. The first peripheral portion defines a mounting hole therethrough and presents a first self-locating leg and a first short leg. The second peripheral portion may, but need not be, generally a mirror image of the first peripheral portion and presents another mounting hole defined therethrough. The second peripheral portion includes a second self-locating leg and a second short leg.

According to a depicted embodiment, the first self-locating leg has a first extension length and is separated from the central portion by a first leg notch. The second self-locating leg has a second extension length and is also separated from the central portion by a second leg notch. Generally, the first extension length and the second extension length are equal.

The first short leg is separated from the central portion by a third leg notch and the second short leg is separated from the central portion by a fourth leg notch. The upwardly extending wings include a first wing and a second wing. The first wing and the second wing extend generally upwardly from the base plate and generally extend inwardly as well. The first wing generally includes an upwardly extending portion and an inwardly extending portion. The upwardly extending portion may be angled inwardly.

The inwardly extending portion extends inwardly relative to the upwardly extending portion and defines a first entrance ramp or curve having a ramp angle and a second entrance ramp having a ramp angle or curve. The ramp angles or curve of the first and second entrance ramp are generally gently sloped.

The second wing may be a generally mirror image structure of the first wing and, similarly, includes an upwardly extending portion and an inwardly extending portion. The upwardly extending portion is angled inwardly.

The inwardly extending portion extends inwardly generally parallel to the base plate and defines a third entrance ramp or curve having a gentle ramp angle and an opposed fourth entrance ramp having a gentle ramp angle or curve. The upwardly extending wings including the first wing and second wing define a slot or gap therebetween.

According to an embodiment, a locking device for use in a window having a frame defining an opening and a sash hinged to the frame and selectively shiftable to close the opening includes a keeper having a base plate with a pair of spaced apart wings extending upwardly therefrom, the wings defining a gap therebetween, and a locking lug. The keeper is attached to one of the sash or the frame and the locking lug is coupled to a locking mechanism on the other of the sash or the frame. The locking lug is selectively shiftable with the locking mechanism between a first position wherein the locking lug is received in the gap between the spaced apart wings of the keeper to secure the sash to the frame, and a second position wherein the locking lug is clear of the keeper to enable the sash to be shifted away from the frame.

In an embodiment, the base plate includes a central portion, a first peripheral portion, and a second peripheral portion. The first peripheral portion can define a mounting hole therethrough and may present a first self-locating leg and a first short leg. The first self-locating leg extends outwardly a distance appropriate to position the keeper relative to a fixed structure which the first self-locating leg abuts, and is separated from the central portion by a first leg notch, and the first short leg extends in a direction generally opposed to the first self-locating leg and is separated from the central portion by a third leg notch. The second peripheral portion can define a mounting hole therethrough and may present a second self-locating leg and a second short leg. The second self-locating leg extends outwardly a distance appropriate to position the keeper relative to a fixed structure which the second self-locating leg abuts, and is separated from the central portion by a second leg notch, and the second short leg extends in a direction generally opposed to the second self-locating leg and is separated from the central portion by a fourth leg notch.

In an embodiment, the upwardly extending wings include a first wing and a second wing, wherein a distal portion of each wing extends inwardly into the gap at an angle of from 50° to 70°, thereby defining a C-Shaped channel. The first wing and second wing may include a first and second entrance ramp, and a third and fourth entrance ramp respectively, wherein each of the entrance ramps presents a curved structure presenting a ramp angle. In further embodiments the first entrance ramp, second entrance ramp, third entrance ramp, and fourth entrance ramp have a rise to run ratio of from three (3) to four (4).

In an embodiment, the locking lug has a head and a shaft, with a width dimension of the head being greater than a width dimension of the shaft, the width dimension of the head being greater than a width dimension of the gap, and a width dimension of the shaft being equal to or less than the width dimension of the gap. The shaft may be surrounded by a sleeve, with the sleeve rotatably received on the shaft so as to function as a roller.

In an embodiment the locking mechanism includes a tie bar, the locking lug being attached to the tie bar. The keeper may be a unitary structure comprised of either polymer material or metal. In embodiments of the invention, the keeper has a ratio of height to width of three (3) to seven (7) respectively.

In an embodiment according to the invention, a window includes a frame defining an opening, and a sash operably coupled to the frame with at least one hinge, the sash selectively receivable in the opening of the frame to close the opening. A locking device is attached to the frame, said locking device having at least one selectively shiftable locking lug. A keeper is attached to the frame for receiving the locking lug. The keeper includes a base plate with a pair of spaced apart wings extending upwardly therefrom, the wings defining a gap therebetween, the locking lug being receivable between the wings to secure the sash to the frame.

In an embodiment, the base plate of the keeper includes a central portion, a first peripheral portion, and a second peripheral portion. In embodiments, the first peripheral portion defines a mounting hole therethrough and presents a first self-locating leg and a first short leg, wherein the first self-locating leg extends outwardly a distance appropriate to position the keeper relative to a surface of the frame which the first self-locating leg abuts, and is separated from the central portion by a first leg notch, and the first short leg extends in a direction generally opposed to the first self-locating leg and is separated from the central portion by a third leg notch. The second peripheral portion can define a mounting hole therethrough and may present a second self-locating leg and a second short leg, wherein the second self-locating leg extends outwardly a distance appropriate to position the keeper relative to a surface of the frame which the second self-locating leg abuts, and is separated from the central portion by a second leg notch, and the second short leg extends in a direction generally opposed to the second self-locating leg and is separated from the central portion by a fourth leg notch.

In an embodiment, the upwardly extending wings include a first wing and a second wing, wherein a distal portion of each wing extends inwardly into the gap at an angle of from 50° to 70°, thereby defining a C-Shaped channel. The first wing and second wing may include a first and second entrance ramp, and a third and fourth entrance ramp respectively, wherein each of the entrance ramps presents a curved structure presenting a ramp angle. In embodiments of the invention, the first entrance ramp, second entrance ramp, third entrance ramp, and fourth entrance ramp have a rise to run ratio of from three (3) to four (4).

A locking lug according to embodiments of the present invention, generally includes a head, a shaft with or without a surrounding roller or sleeve, and a base coupled to a supporting structure. The head has a head width and the shaft has a shaft width. The sleeve provided over the shaft has a sleeve width. The head with is somewhat larger than the shaft/sleeve width. The shaft/sleeve width is receivable into the slot while the head width is larger than the slot. The base is coupled to a supporting structure which is a part of a lock mechanism. Further details of a locking mechanism that can be used with the keeper according to embodiments of the present invention may be found in U.S. Pat. No. 7,452,014, which is hereby incorporated herein in its entirety by reference. It will be appreciated that many other lock mechanisms may be used with the keeper of the present invention so long as the locking mechanism functions to engage a locking lug with the keeper.

BRIEF DESCRIPTION OF THE DRAWINGS

The embodiments of the present invention may be more completely understood in consideration of the following detailed description of various embodiments in connection with the accompanying drawings, in which.

Figure 1:
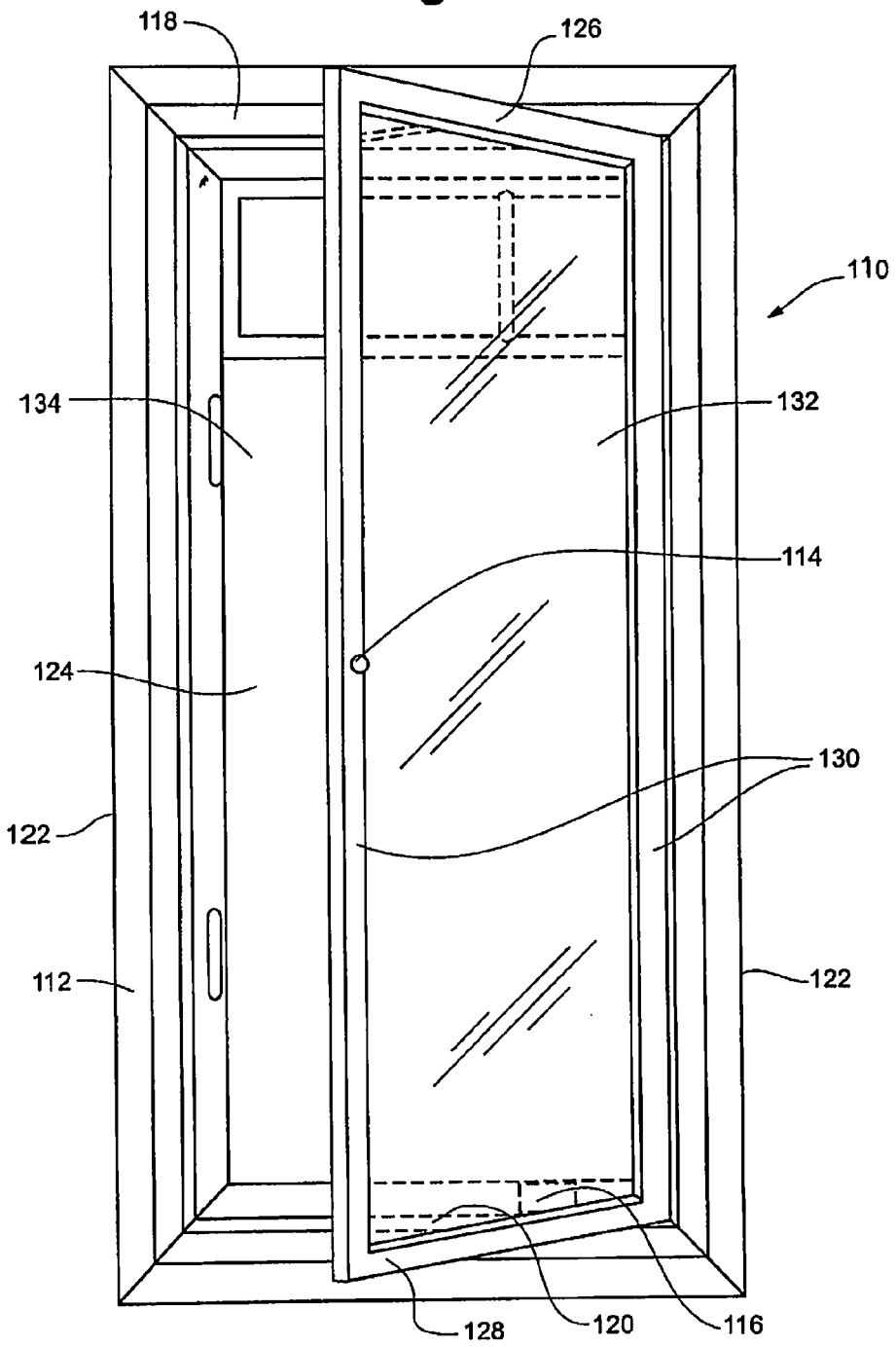
FIG. 1 is a perspective view of an example casement window with which example embodiments of the invention may be utilized.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Figure 2:
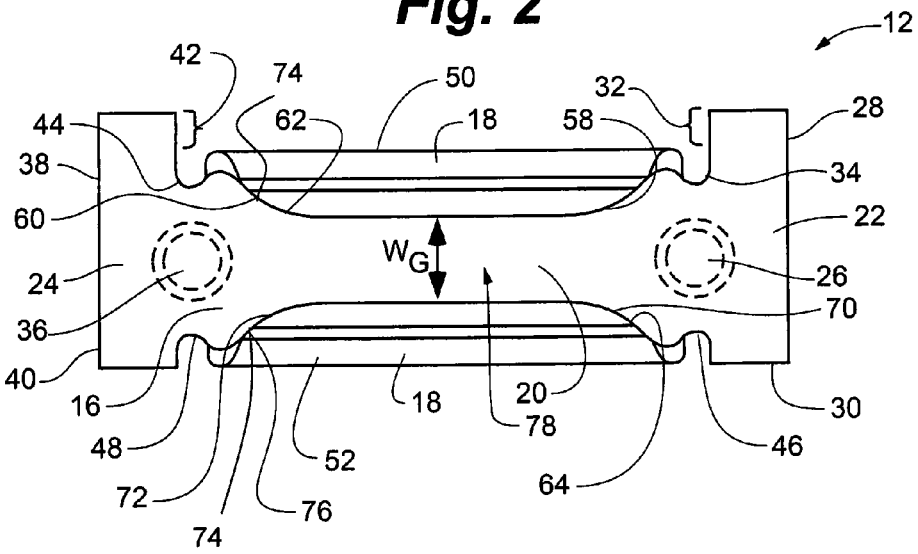
FIG. 2 is a plan view of a keeper according to an example embodiment of the invention.
Figure 3:
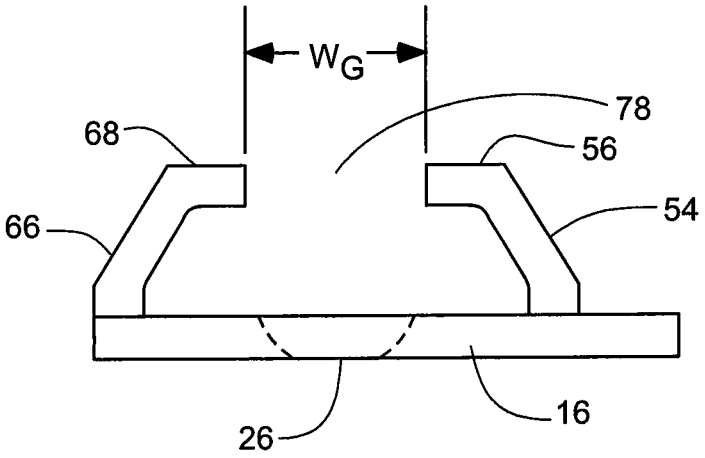
FIG. 3 is a sectional view of the keeper of FIG. 2 according to an example embodiment of the invention.
Figure 4:
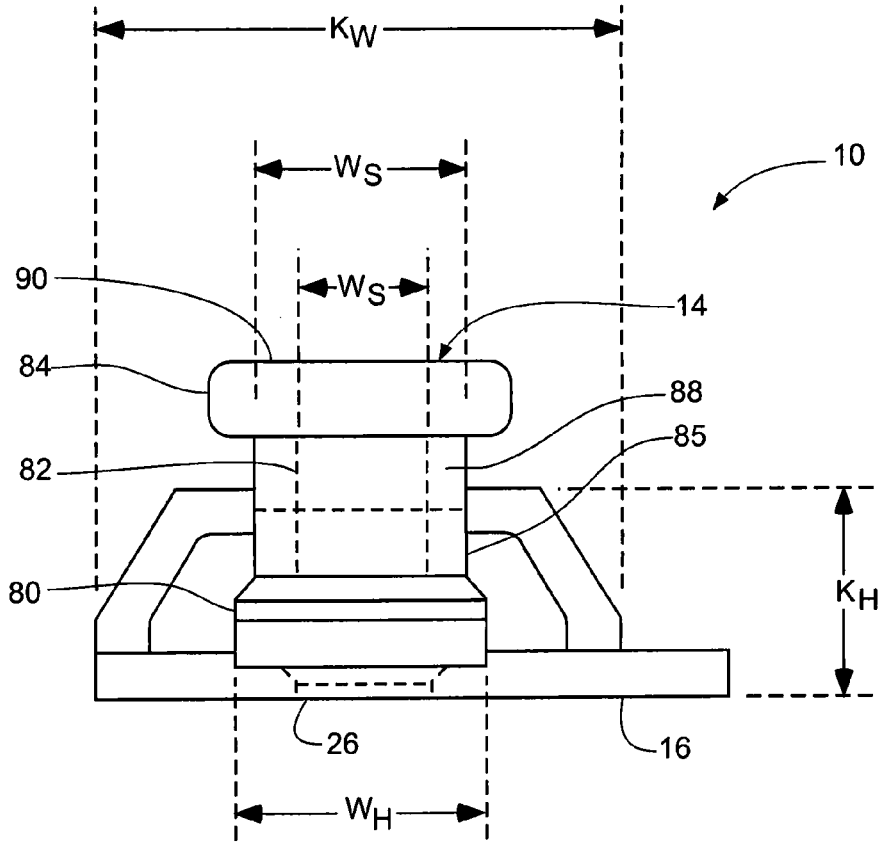
FIG. 4 is a partly elevational, partly sectional view of a keeper according to an example embodiment of the invention engaged to a locking lug.

Referring particularly to FIGS. 2-4, lock mechanism 10 generally includes keeper 12 and locking lug 14. Locking lug 14 is coupled to a tie bar assembly 84 as is well-known in the art, and as is described in an exemplary embodiment in U.S. Pat. No. 7,452,014, hereby fully incorporated herein by reference. Keeper 12 is a generally unitary structure. Keeper 12 may be formed of any material of sufficient strength and ridgity. Generally, keeper 12 will be formed of metal or suitable polymer composite. Keeper 12 may be formed by stamping and forming sheet metal or may be formed by other manufacturing methods such as casting or extrusion and machining. In addition to metals, keeper 12 may be formed from composite, plastics or other material known to those of ordinary skill in the art.

Referring to FIGS. 2 and 3, keeper 12 generally includes base plate 16 and upwardly extending wings 18.

Base plate 16 generally includes central portion 20, first peripheral portion 22 and second peripheral portion 24. In the depicted embodiment, base plate 16 is integrally formed along with upwardly extending wings 18 but this should not be considered limiting. Central portion 20 supports upwardly extending wings 18.

First peripheral portion 22 defines mounting hole 26 and includes first self-locating leg 28 and first short leg 30. First self-locating leg 28 extends outwardly first extension length 32. First self-locating leg 28 is separated from central portion 20 by first leg notch 34. First extension length 32 may be variable and is of a length appropriate to be position keeper 12 relative to a fixed structure of frame 112 or sash 114 which first self locating leg 28 abuts. First short leg 30 extends in a direction generally opposed to first self-locating leg 28.

Second peripheral portion 24 defines mounting hole 36 and includes second self-locating leg 38 and second short leg 40. Second self-locating leg 38 has second extension length 42 and is separated from central portion 20 by a second leg notch 44.

First short leg 30 is separated from central portion 20 by third leg notch 46. Second short leg 40 is separated from central portion 20 by fourth leg notch 48.

Referring particularly to FIGS. 2 and 3, upwardly extending wings 18 generally include first wing 50 and second wing 52. First wing 50 generally includes upwardly extending portion 54 and inwardly extending portion 56. Upwardly extending portion 54 is angled generally inwardly. Upwardly extending portion 54 and upwardly extending portion 66 are angled inwardly at an angle of approximately 60° plus or minus 10°.

Inwardly extending portion 56 generally includes first entrance ramp 58 and second entrance ramp 60. Each of first entrance ramp 58 and second entrance ramp 60 presents a curved entrance ramp structure. Curved ramp structure 62 presents a ramp angle. As compared to the prior art, first entrance ramp 58 and second entrance ramp 60 present a ramp angle 64 which is shallow relative to that generally found in the prior art.

Second wing 52 generally includes upwardly extending portion 66 and inwardly extending portion 68. Upwardly extending portion 66 is angled generally inwardly. Third entrance ramp 70 and fourth entrance ramp 72 are similar to first entrance ramp 58 and second entrance ramp 60 of first wing 50. Third entrance ramp 70 and fourth entrance ramp 72 present curved ramp structure 74 having ramp angle 76. First wing 50 and second wing 52 together define lug receiving slot or gap 78 therebetween.

Referring particularly to FIG. 4, locking lug 14 generally presents head 80, shaft 82, sleeve 85, and is operably coupled to tie bar 84. Head 80 presents head width $W_H$. Shaft 82 presents shaft width $W_S$, and sleeve 85 presents sleeve width $W_{SL}$. Sleeve 85 may be rotatably received on shaft 82 so as to function as a roller. Head width $W_H$ is larger than shaft width $W_S$, sleeve width $W_{SL}$, and also larger than width $W_G$ of lug receiving gap 78. Shaft width $W_S$ and sleeve width $W_{SL}$ are smaller than head width $W_H$ and appropriate to be received in lug receiving gap 78.

Referring particularly to FIG. 3, in a preferred embodiment, keeper 12 has a ratio of height to width of approximate three to seven based on the externally measured height $K_H$ and outside width $K_W$ of upwardly extending wings 18 as viewed in cross section.

Referring particularly to FIG. 2, first entrance ramp 58, second entrance ramp 60, third entrance ramp 70 and fourth entrance ramp 72 in a preferred embodiment may have a rise to run ratio of about three to four. While it is known in the art to refer to the ramp angle, it is apparent in the depicted embodiment that the structure first entrance ramp 58, second entrance ramp 60, third entrance ramp 70 and fourth entrance ramp 72 is a curve having a continuously varying angle. Thus, the rise to run ratio above may be considered to define a "ramp angle" even though the "angle" of each first entrance ramp 58, second entrance ramp 60, third entrance ramp 70 and fourth entrance ramp 72 varies continuously.

Figure 5:
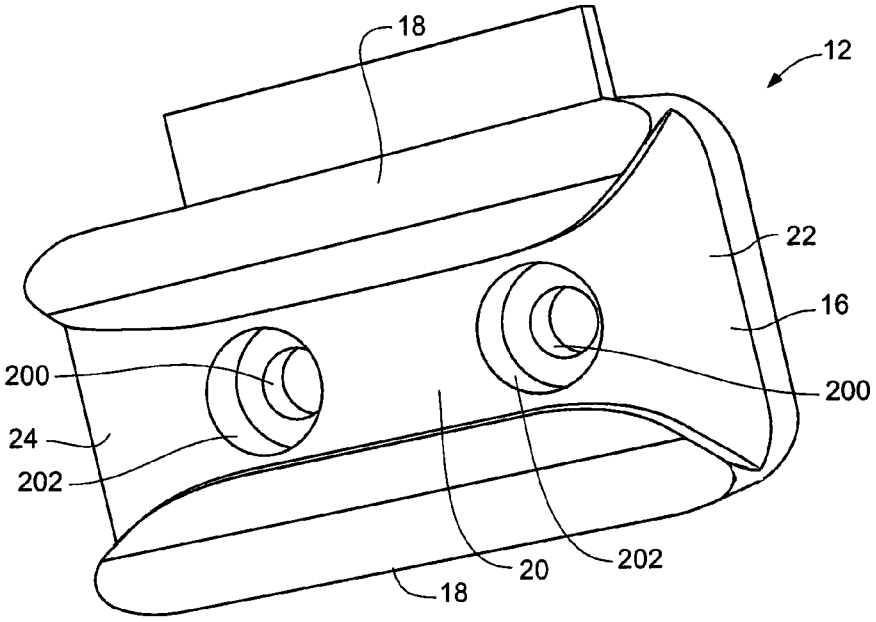
FIG. 5 is an isometric view of a keeper formed from polymer composite material according to an example embodiment of the invention.

FIG. 5 depicts a keeper 12 according to an embodiment of the invention, in which the keeper 12 is formed from polymer composite material. The structure, geometry, and function of keeper 12 is substantially the same as previously described, except that in this embodiment, keeper 12 has mounting holes 200 with surrounding counter-sunk regions 202, mounting holes 200 receiving fasteners (not depicted) for securing keeper 12 to the sash 114, and with the heads of the fasteners being received in counter-sunk regions 202.

For reference purposes, an example of casement window 110 is depicted in FIG. 1. Casement window 110 generally includes frame 112, sash 114, and operator mechanism 116. Frame 112 includes head jamb 118, sill 120, and sides 122 and defines window opening 124. Sash 114 includes top rail 126, bottom 128, side rails 130, and window pane 132. Sash 114 may also include screen 134. Sash 114 is typically coupled with hinges (not shown) to frame 112 and can be opened and closed through operation of operator mechanism 116.

In operation, keeper 12 is secured to one of frame 112 and sash 114. Locking lug 14 is operably secured to the other of frame 112 and sash 114 via tie bar 84. Keeper 12 is typically secured by fasteners (not shown) inserted through mounting holes 26 and 36 and secured into either frame 112 or sash 114. Fasteners (not shown) are generally screws but this should not be considered limiting. Keeper 12 may be secured by other structures or methods known to those of ordinary skilled in the art.

When it is desired to lock casement window 110, casement window is closed and locking lug 14 is moved via shifting of tie bar 84 to engage keeper 12. Shaft 82 and sleeve 85 of locking lug 14 is received into lug receiving gap 78. Sleeve 85 engages first wing 50 and second wing 52 at inwardly extending portion 56 and inwardly extending portion 68.

Ramp angle 76 of first entrance ramp 58, second entrance ramp 60, third entrance ramp 70 and fourth entrance ramp 72 facilities easy passage of locking lug 14 into lug receiving gap 78.

Sleeve 85 is received closely in lug receiving gap 78. Head 80 is secured within keeper 12 because head $W_H$ is larger than width $W_G$ of lug receiving gap 78. Thus, if casement window 110 is put under substantial stress so that sash 114 tends to open relative to frame 112, locking lug 14 is held securely by lug receiving 78 because head 80 impinges against first wing 50 and second wing 52. Thus, if sash 114 starts to deflect under stress causing locking lug 14 to tilt, head 80 of locking lug 14 is captured and is securely held in place by first wing 50 and second wing 52.

When keeper 12 is secured to frame 112 or sash 114, first self-locating leg 28 and second self-locating leg 38 are abutted against a portion of the structure of frame 112 or sash 114, thus positioning keeper 12 without the need for jigs or fixtures to secure it in its proper location.

Because keeper 12 is non-handed, the number of keepers 12 designs that need to be kept on hand by a manufacturer is halved. Keeper 12 can be applied on left or right handed casement windows 110 or awning windows.

Keeper 12 has an aesthetically pleasing appearance because of its structure and thus provides a clean and minimal visible hardware appearance on frame 112 or sash 114.

References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of 35 U.S.C. §112(f) are not to be invoked unless the specific terms "means for" or "step for" are recited in the subject claim.

The invention claimed is:

1. A locking device for use in a window having a frame defining an opening and a sash hinged to the frame and selectively shiftable to close the opening, the locking device comprising:

a keeper including a base plate with a pair of spaced apart wings extending upwardly therefrom, each wing angled inwardly at an angle of from 50° to 70° relative to the base plate and including a distal end portion oriented substantially parallel with the base plate, the distal end portions of the wings defining a gap therebeween, the spaced apart wings including a first wing and a second wing, wherein a length of the first wing at the distal end portion is less than a length of the first wing at a proximal end portion thereof, and a length of the second wing at the distal end portion is less than a length of the second wing at a proximal end portion thereof, the first wing including a first and second entrance ramp, and the second wing including a third and fourth entrance ramp, wherein each of the entrance ramps presents a curved structure presenting a ramp angle; and a locking lug having a head and a shaft, a width dimension of the head being greater than a width dimension of the shaft, the width dimension of the head being greater than a width dimension of the gap, and a width dimension of the shaft being equal to or less than the width dimension of the gap, wherein the keeper is attached with the base plate abutting one of the sash or the frame and the locking lug is coupled to a locking mechanism on the other of the sash or the frame, and wherein the locking lug is selectively shiftable with the locking mechanism between a first position wherein the locking lug is received in the gap between the spaced apart wings of the keeper to secure the sash to the frame, and a second position wherein the locking lug is clear of the keeper to enable the sash to be shifted away from the frame.

2. The device of claim 1, wherein the base plate includes a central portion, a first peripheral portion, and a second peripheral portion.

3. The device of claim 2, wherein the first peripheral portion defines a mounting hole therethrough and presents a first self-locating leg and a first short leg, wherein the first self-locating leg extends outwardly a distance appropriate to position the keeper relative to a fixed structure which the first self-locating leg abuts, and is separated from the central portion by a first leg notch, and the first short leg extends in a direction generally opposed to the first self-locating leg and is separated from the central portion by a third leg notch.

4. The device of claim 2, wherein the second peripheral portion defines a mounting hole therethrough and presents a second self-locating leg and a second short leg, wherein the second self-locating leg extends outwardly a distance appropriate to position the keeper relative to a fixed structure which the second self-locating leg abuts, and is separated from the central portion by a second leg notch, and the second short leg extends in a direction generally opposed to the second self-locating leg and is separated from the central portion by a fourth leg notch.

5. The device of claim 1, wherein the first entrance ramp, second entrance ramp, third entrance ramp, and fourth entrance ramp have a rise to run ratio of from three (3) to four (4).

6. The device of claim 1, wherein the shaft is surrounded by a sleeve, and wherein the sleeve is rotatably received on the shaft so as to function as a roller.

7. The device of claim 1, wherein the locking mechanism includes a tie bar, the locking lug being attached to the tie bar.

8. The device of claim 1, wherein the keeper is a unitary structure comprised of polymer material.

9. The device of claim 1, wherein the keeper has a ratio of height to width of three (3) to seven (7) respectively.

10. A window comprising:

a frame defining an opening;

a sash operably coupled to the frame with at least one hinge, the sash selectively receivable in the opening of the frame to close the opening;

a locking device attached to the sash, said locking device having at least one selectively shiftable locking lug; and a keeper attached to the frame for receiving the locking lug, the keeper comprising a base plate with a pair of spaced apart wings extending upwardly therefrom, each wing angled inwardly at an angle of from 50° to 70° relative to the base plate and including a distal end portion oriented substantially parallel with the base plate, the distal end portions of the wings defining a gap therebeween, the spaced apart wings including a first wing and a second wing, wherein a length of the first wing at the distal end portion is less than a length of the first wing at a proximal end portion thereof, and a length of the second wing at the distal end portion is less than a length of the second wing at a proximal end portion thereof, the first wing including a first and second entrance ramp, and the second wing including a third and fourth entrance ramp, wherein each of the entrance ramps presents a curved structure presenting a ramp angle, the base plate abutting the frame, the locking lug having a head and a shaft, a width dimension of the head being greater than a width dimension of the shaft, the width dimension of the head being greater than a width dimension of the gap, and a width dimension of the shaft being equal to or less than the width dimension of the gap so that the locking lug is receivable in the gap to secure the sash to the frame.

11. The window of claim 10, wherein the base plate of the keeper includes a central portion, a first peripheral portion, and a second peripheral portion.

12. The window of claim 11, wherein the first peripheral portion defines a mounting hole therethrough and presents a first self-locating leg and a first short leg, wherein the first self-locating leg extends outwardly a distance appropriate to position the keeper relative to a surface of the frame which the first self-locating leg abuts, and is separated from the central portion by a first leg notch, and the first short leg extends in a direction generally opposed to the first self-locating leg and is separated from the central portion by a third leg notch.

13. The window of claim 11, wherein the second peripheral portion defines a mounting hole therethrough and presents a second self-locating leg and a second short leg, wherein the second self-locating leg extends outwardly a distance appropriate to position the keeper relative to a surface of the frame which the second self-locating leg abuts, and is separated from the central portion by a second leg notch, and the second short leg extends in a direction generally opposed to the second self-locating leg and is separated from the central portion by a fourth leg notch.

14. The window of claim 10, wherein the first entrance ramp, second entrance ramp, third entrance ramp, and fourth entrance ramp have a rise to run ratio of from three (3) to four (4).

* * * * *